United States Patent [19]

Welden

[11] Patent Number: 4,462,342

[45] Date of Patent: Jul. 31, 1984

[54] VARIABLE STAGE DIRECT FIELD BOILER

[76] Inventor: David P. Welden, 516 E. Rocksylvania, Iowa Falls, Hardin County, Iowa 50126

[21] Appl. No.: 346,839

[22] Filed: Feb. 8, 1982

[51] Int. Cl.[3] ..... F22B 1/18; F02C 7/00

[52] U.S. Cl. ..... 122/448 R; 122/438; 122/39; 122/41

[58] Field of Search ..... 110/215, 189, 192, 101 CB; 122/5.5 A, 446, 448 R, 448 A, 39, 40, 41, 438; 60/39.03, 39.53, 39.55; 126/360 A, 360 R, 351; 431/19

[56] References Cited

U.S. PATENT DOCUMENTS

| | | | |
|---|---|---|---|
| Re. 26,167 | 3/1967 | Schuss et al. | 431/19 |
| 880,720 | 2/1904 | Cole | 73/749 X |
| 1,988,456 | 3/1931 | Lysholm | 60/39.55 |
| 2,536,597 | 1/1951 | Goddard | 60/39.55 X |
| 2,763,987 | 9/1956 | Kretschmer | 60/39.55 |
| 3,241,597 | 3/1966 | Juzi | 236/26 R |
| 3,461,667 | 8/1969 | Aguet | 60/39.55 X |
| 3,625,186 | 12/1971 | Herbst | 122/448 R X |
| 3,887,325 | 6/1975 | Finger et al. | 122/448 R X |
| 3,980,137 | 9/1976 | Gray | 166/303 |
| 4,079,586 | 3/1978 | Kincaid, Jr. | 60/39.55 X |
| 4,141,343 | 2/1979 | Awano et al. | 126/360 A |
| 4,178,907 | 12/1979 | Sweat, Jr. | 126/101 |
| 4,211,071 | 7/1980 | Wyatt | 60/39.55 |
| 4,266,599 | 5/1981 | Saunders et al. | 165/2 |
| 4,288,978 | 9/1981 | Wyatt | 60/39.05 |

FOREIGN PATENT DOCUMENTS

| | | | |
|---|---|---|---|
| 54-143946 | 11/1979 | Japan | 126/360 R |
| 476195 | 12/1937 | United Kingdom | 60/39.55 |

*Primary Examiner*—Henry C. Yuen

*Attorney, Agent, or Firm*—Henderson & Sturm

[57] ABSTRACT

A variable stage direct fired boiler having at least three output-pressure sensitive combustion stages. A separate pressure switch controls each stage such that none, one or more stages may be engaged in combustion depending upon the desired output pressure and the actual output pressure.

9 Claims, 7 Drawing Figures

VARIABLE STAGE DIRECT FIELD BOILER

TECHNICAL FIELD

This invention relates generally to steam boilers.

BACKGROUND ART

In a standard boiler mechanism, burnt combustion gases are exhausted through a separate output from the steam output. In a direct fired boiler, such burnt combustion gases are exhausted through the same output as the steam. Various direct fired boiler mechanisms are known in the prior art for producing an output of steam. The prior art lacks, however, a pressure controlled variable output direct fired steam boiler. Such a boiler would ideally monitor its own output and control its own consumption of fuel in response thereto. Such a mechanism should also vary the supply of water delivered to the boiler for conversion to steam in response to the necessary amount of water required to achieve a particular desired output. Finally, such a mechanism should provide an adequate supply of combustion air to the combustion chamber.

DISCLOSURE OF THE INVENTION

These and other problems found in the prior art are resolved by the provision of a variable combustion stage direct fired boiler. This boiler includes a combustion chamber and a vertical pass liquid to steam coverter connected operably to the combustion chamber. Fuel, combustion air and water are introduced into the combustion chamber where the fuel ignites and burns. The heat created by the burning fuel causes the water to turn to steam. The entire contents of the combustion chamber constitute the output, including particularly the water that has been converted to steam.

To assist in converting the water to steam, the applicant has provided a vertical pass liquid-to-steam converter at the bottom or output of the combustion chamber. This converter provides for the discharge of the pressurized contents of the combustion chamber into the converter. The pressurized contents of the combustion chamber, including steam and water particles not yet converted to steam, must then travel through a series of up and down vertical paths formed around a plurality of substantially concentric vertical partitions.

As the water particles travel this path, they are continually subjected to heat from the combustion chamber. This results in an additional conversion of liquid to steam than would result if the combustion chamber were not attached to such a converter.

The interior of the combustion chamber includes three burners, each comprising a controllable stage in the combustion process. More particularly, each stage comprises a burner, a fuel valve, a water valve, an ignition mechanism and a combustion air supply mechanism. During use, one, two or all three stages may be operating.

Only burners that are supposed to be currently engaged in combustion are provided with fuel. The delivery of such fuel may be controlled by a solenoid operated fuel valve associated with each burner.

In a similar manner, this invention provides one quantity of delivered combustion air when one burner is operating, a larger quantity of combustion air when two burners are operating, and yet a larger supply of combustion air when all three burners are operating.

Finally, the quantity of water delivered to the interior of the combustion chamber for conversion to steam varies in accordance with how many stages or burners are operating. That is, a certain quantity of water is delivered when only one burner is operating, a larger quantity of water is delivered when two burners are operating, and yet a larger quantity of water is delivered when all three burners are operating.

To determine how many stages to operate at a given moment, the applicant monitors the output pressure. Controls responsive to such monitoring are pre-set to operate the first stage under a particular operating range of output pressure, the second stage during a second operating range of output pressure and the third stage during a third range of output pressure.

For instance, the first stage might be set to operate so long as the output pressure does not exceed 351.50 grams per square centimeter (5 pounds per square inch) over atmospheric conditions. The second stage might be set to operate so long as the output pressure does not exceed 210.80 grams per square centimeter (3 pounds per square inch) over atmospheric conditions. The third stage might be set to operate so long as the monitored output pressure does not exceed 105.45 grams per square centimeter (1½ pounds per square inch) of pressure over atmospheric conditions.

To protect against the unnecessary consumption of fuel and energy during start up, the applicant has provided for a delay mechanism in both the second and third stage control circuitry. The master control unit of the boiler will initiate the first stage of combustion and then wait thirty seconds before initiating the second stage. The unit will then wait yet another thirty seconds before initiating the third stage.

Although the initial output pressure might be sufficiently low to otherwise cause an instruction that would allow all three stages to operate during start up of the boiler, such conditions may change rapidly during the start up procedure. The output pressure will often exceed the operating ranges of the second and third stage after only a few moments of initial operation. If the delay mechanisms were not provided, then the unnecessary firing of the second and third combustion stages would regularly result.

Combustion air is provided to the combustion chamber through a centrally located position atop the combustion chamber. In order to facilitate the introduction of combustion air into the chamber such that the air does not travel too quickly through the combustion chamber, the applicant provides fan-like blades to cause turbulence and disrupt the flow of air into the chamber. This disrupted flow of air than makes its way to the output more slowly and helps assure an adequate supply of oxygen in the combustion chamber for combustion purposes.

For the same purpose, the applicant also provides a supplemental input of air into the combustion chamber. This supplemental supply connects through the side of the combustion chamber proximal its upper end. The supplemental supply enters the chamber at an angle nearly tangential the chamber wall. In consequence, combustion air introduced into the chamber through this supplemental feed will swirl around inside the chamber as determined by the interior geometry of the chamber. This also assists in assuring an adequate supply of combustion air at the situs of the burners.

The applicant also provides a new pressure switch suitable for use in monitoring the output of the boiler and for controlling the firing of the three combustion stages. The pressure switch consists of a U-shaped plastic tube having one leg bent horizontal to facilitate pneumatic connection to the boiler output. The tube itself has an electrical conductor positioned through the tube at the vertex thereof, and also at three positions along either leg, in this case, the bent leg. Upon filling the tube with mercury, it will be appreciated that the mercury will move in the tube in response to pressure introduced from the boiler output. The greater the pressure, the more the mercury will be moved.

By placing the three spaced conductors to correspond to particular pressure settings, and by then attching the conductors to an appropriate circuit, it will be appreciated that the mercury in the tube acts as a closed switch. As pressure in the boiler forces the level of mercury down the bent leg, the mercury will break contact with each conductor in order, thereby opening the switch represented thereby.

BRIEF DESCRIPTION OF THE DRAWINGS

These and other attributes of the invention will become more clear upon a review of the following detailed description of the best mode for carrying out the invention, particularly when reviewed in conjunction with the drawings, wherein.

BEST MODE FOR CARRYING OUT THE INVENTION

Figures 1, 7:
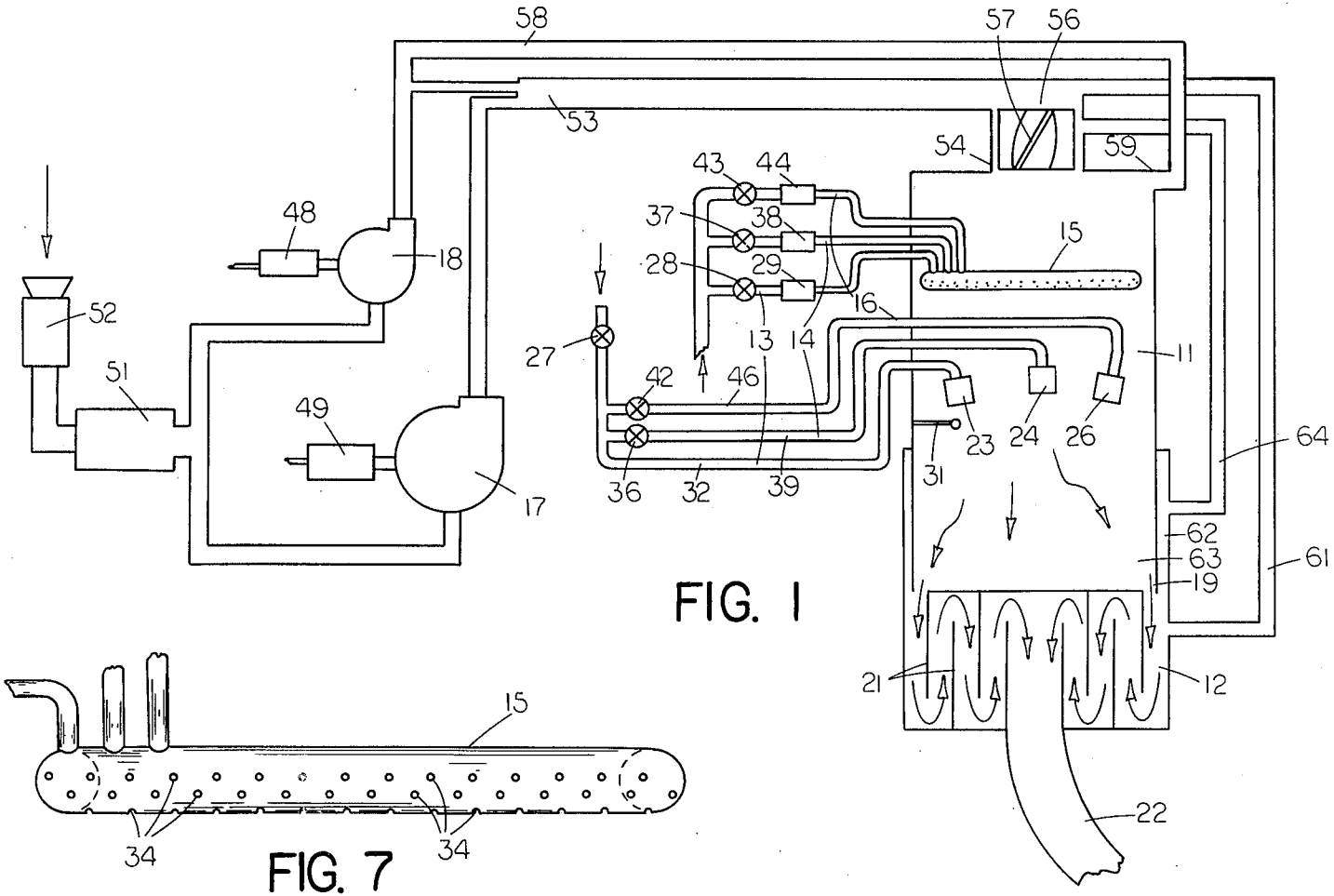
FIG. 1 is a block diagram view of the invention.
FIG. 7 is an enlarged front elevational view of the water ring feed mechanism.

The non-electrical components of the invention will now be disclosed with reference to FIG. 1. The invention includes generally a combustion chamber (11), a vertical pass liquid-to-steam converter (12), first, second and third stages of a fuel and water feed and combustion system (13, 14 and 16), a water ring feed mechanism (15) and two air blowers (17 and 18).

The combustion chamber (11) consists of a substantially cylindrical-shaped metal enclosure. Various sealed ports are provided as indicated below to allow ingress of fuel, water and combustion air. The combustion chamber (11) also provides for egress at the bottom (19), where the chamber (11) connects to the vertical pass liquid-to-steam converter (12).

The vertical pass liquid-to-steam converter (12) consists of a substantially sealed chamber having a series of vertical panels (21) affixed therein to form a twisting pneumatic pathway. Air, combusted fuel, steam, and liquid water particles from within the combustion chamber (11) may enter the converter (12) near its outer periphery. Such material must then travel through three downward and two upward vertical passes in close proximity to heat from the combustion chamber (11) before the material reaches the output port (22).

A first stage burner (23), a second stage burner (24) and a third stage burner (26) are affixed within the combustion chamber (11). The burners are located such that fuel exiting from either the second or third stage burner (24 and 26) may be ignited by flame issuing from the first stage burner (23).

The water ring feed mechanism (15) includes an annularly-shaped tube having input ports for connecting to the water lines described below and a plurality of holes (34) disposed therethrough to allow water contained therein to escape. These holes (34) are located along the bottom of the tube and along the side as well. Therefore, as more water is introduced into the tube as described below, a greater volume of water may be equally distributed inside the combustion chamber (11) by exiting it through more holes (34).

In order to facilitate the conversion of such water to steam, the applicant has determined that the water ring feed mechanism (15) should be located so that water exiting through the holes will trickle down the interior side walls of the combustion chamber (11). This orientation works particularly well where the combustion chamber (11) connects to a vertical pass liquid-to-steam converter (12) as shown.

The first stage fuel and water feed and combustion system includes a main fuel valve (27), a first stage burner (23) mentioned above, a first stage water valve (28) and pressure regulator (29) and an ignition mechanism (31).

The main fuel valve (27) may be part no. 8210B542NC as manufactured by the ASCO Company and connects between a fuel supply (not shown) and the first stage burner (23) by means of appropriate piping (32). This valve (27) may be closed, such that no fuel flows to the burner (23), or open, such that fuel may flow unimpeded to the first stage burner (23).

The water valve (28) (which may be part no. 8262A212-2NC as manufactured by the ASCO Company) and pressure regulator (29) are connected in series between a source of pressurized water (not shown) and the water ring feed mechanism (15) by means of appropriate piping (33). This water valve (28) may be closed to completely restrict the flow of water through it, or it may be open to allow water to enter the combustion chamber (11).

Finally, the first stage system includes an ignition mechanism (31) located proximal the first stage burner (23) to cause fuel exiting from the burner (23) during start up to ignite. Once the burner (23) has ignited, of course, the flame will continue until either the fuel or air supply are cut off. Many such ignition mechanisms are well known in the prior art and no further detailed discussion need be presented here.

The second stage fuel and water feed and combustion system includes a fuel valve (36), a burner (24), and a water valve (37) and pressure regulator (38).

The second stage fuel valve (36), which may be part no. 8210C94-2NC as manufactured by the ASCO Company, connects between the main fuel valve (27) and the second stage burner (24) by means of appropriate piping (39). In order for fuel to reach the second stage burner (24), both the second stage fuel valve (36) and the main fuel valve (27) must be open. If either is closed, no fuel will reach the second stage burner (24).

The second stage water valve (37) (which may be supplied as a part identical to the first stage water valve) and pressure regulator (38) are configured identical to the first stage water valve (28) and pressure regulator (29).

The third stage fuel and water feed and combustion system also includes a fuel valve (42), a burner (26), and a water valve (43) and pressure regulator (44).

Like the second stage fuel valve (36), the third stage fuel valve (42) (which may be supplied by a part identical to the second stage fuel valve) connects between the main fuel valve (27) and the third stage burner (26) by means of appropriate piping (46). Again, both valves (27 and 42) must be open for fuel to reach the third stage burner (26).

The third stage water valve (45) (which may also be supplied by a part identical to the first stage water valve) and pressure regulator (44) are also configured identical to the first stage water valve (28) and pressure regulator (29).

The two air blowers (17 and 18) include a small blower (18) powered by a 5 hp motor (48) and a large blower (17) powered by a 10 hp motor (49). The small blower (18) may be part no. 4MB and the large blower (17) may be part no. 5MB, both as manufactured by the Fuller Company. Both blower motors may be obtained from the Lincoln Electric Company. Both blowers (17 and 18) receive filtered air through a silenced input system. The input includes a large intake silencer (51) or muffler (such as part no. B13-4-71046 by Stoddard Silencers) and an intake filter (52) (such as part no. F64-4-46046 by Stoddard Silencers).

Both blowers (17 and 18) exhaust into a primary air delivery line (53). This line (53) constitutes a pneumatic path leading from the blower outputs to the combustion chamber (11). The primary air delivery line (53) connects to the top of the combustion chamber (11) at a centrally mounted position (54).

Figure 6:
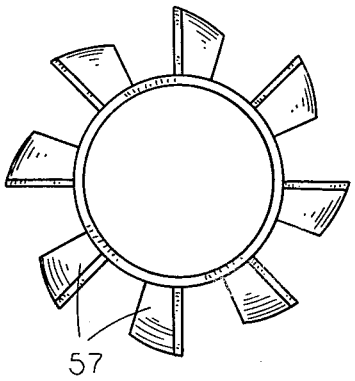
FIG. 6 is an enlarged top plan view of the air-flow disruption mechanism.

The mounting fixture (56) for connecting the primary air delivery line (53) to the combustion chamber (11) may include a plurality of fan-like blades (57) disposed within it. As shown in FIGS. 1 and 6, these blades (57) disrupt the flow of air into the chamber (11) and cause turbulence. This in turn slows down the descent of combustible oxygen through the chamber (11) and assures that an adequate quantity of oxygen will be available at the three burners (23, 24 and 26) to support combustion.

In addition to connecting to the primary air delivery line (53), the output of the small blower (18) also connects to a supplemental air delivery line (58). This line (58) connects to the side of the combustion chamber (11) proximal the top (59) thereof. Further, the line (58) connects nearly tangentially to the chamber (11). In consequence, air entering the chamber (11) through this line (58) will swirl around inside the chamber (11). This pneumatic mixing action further assures that the descent of combustion air through the chamber (11) will be slow enough to assure a favorable combustion environment in the vicinity of the burners (23, 24 and 26).

Additional pneumatic pathways (61 & 64) may also be connected to the vertical pass liquid-to-steam converter (12). The outer periphery (62) of the converter (12) may also be extended to surround the lower portion (63) of the combustion chamber (11). With these pneumatic pathways (61 & 64) connected to the extended converter (12), the periphery (62) of the converter (12) becomes an insulation jacket for the hottest portion of the combustion chamber (11). This also serves to preheat some of the air being introduced into the vertical pass liquid-to-steam converter (12).

Figure 2:
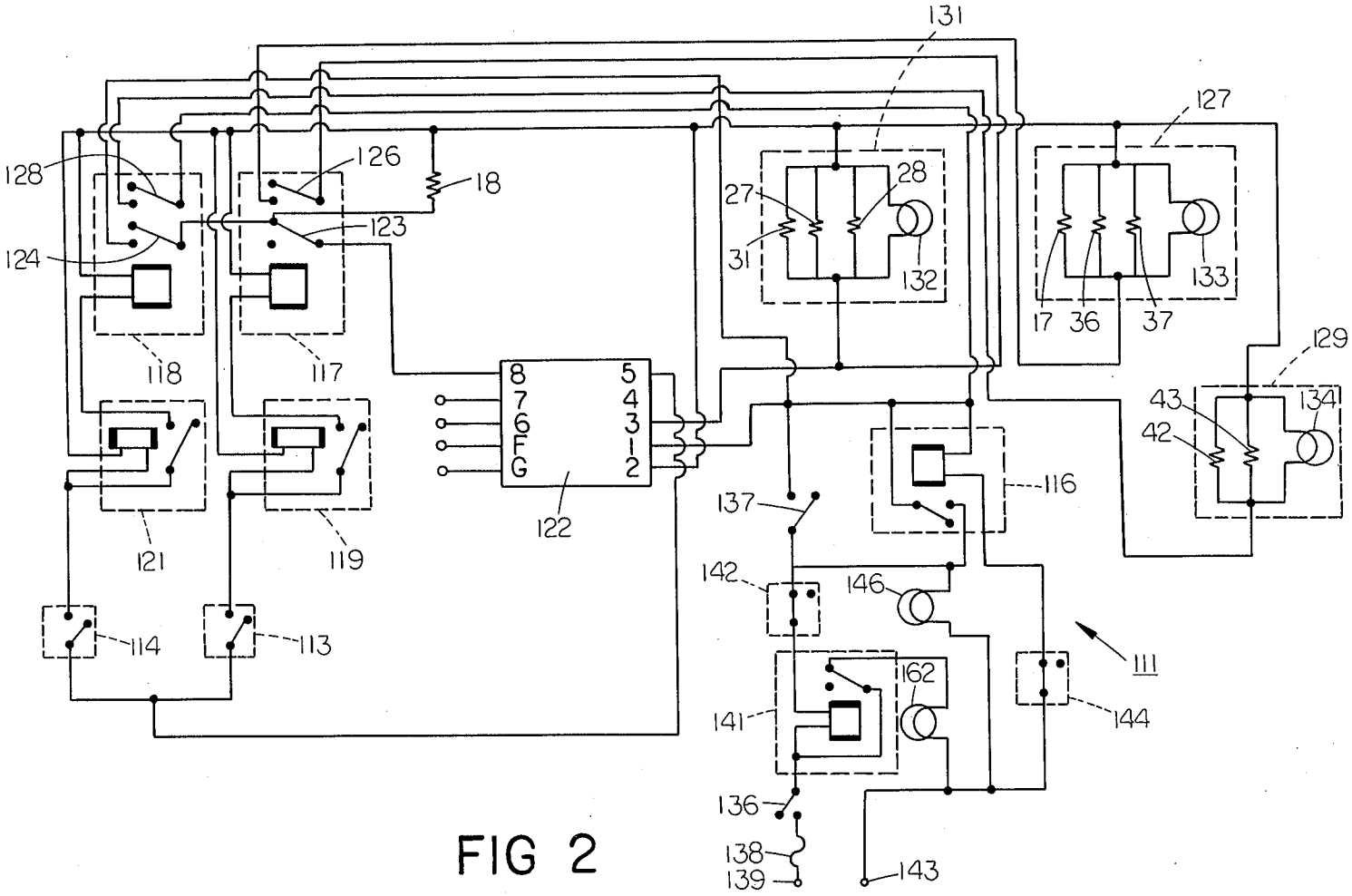
FIG. 2 is a schematic diagram of the control circuitry for the invention.

The electronic components and wiring connections of the variable output direct fired boiler may now be disclosed with reference to FIG. 2. The electrical system includes generally a starting unit (111), a high, medium and low pressure switch (144, 113, and 114), a first, second and third stage relay (116, 117, and 118), a second and third stage timer (119 and 121) and a master control unit (122).

The master control unit (122) provides an initial purge of the combustion chamber (11), provides ignition control of at least one burner (23), and monitors for the presence of a flame in the combustion chamber (11). The master control unit (122) may be comprised of a Honeywell R4795A flame safeguard primary control.

The F and G inputs of the master control unit (122) are connected to an appropriate flame detection device (not shown) as mounted in the combustion chamber (11), such as any suitable prior art ultraviolet flame detector. Inputs 6 and 7 are connected to a pressure switch mounted to monitor the pressure within the combustion chamber.

Input 8 of the master control unit (122) connects through a normally closed switch (123) inside the second stage relay (117) to the small blower (18), as well as to a normally open switch (124) inside the third stage relay (118). The remaining side of this switch (124) inside the third stage relay (118) connects to input 1 of the master control unit (122). Therefore, when the second stage relay (117) energizes, the normally closed switch (123) opens and disconnects the small blower (18) from input 8 of the master unit (122). Similarly, when the third stage relay (118) energizes, the normally open switch (124) located therein closes and connects the small blower (18) to input 1 of the master control unit (122).

Pin 5 of the master control unit (122) connects to both the low and medium pressure switches (114 and 113). These two switches (114 and 113) are normally open, but close in response to particular pressure conditions at the output (22) of the monitored combustion chamber (11).

The low pressure switch (114) connects to the third stage timer (121) and the medium pressure switch (113) connects to the second stage timer (119). The remaining side of both timers (121 and 119) connects to pin 2 of the master control unit (122).

Each timer unit (121 and 119) may be provided by use of part no. TDML-120AL as manufactured by the SSAC Company. These devices may be set to close an internal switch upon the expiration of a pre-set timed interval. Here, the applicant prefers to set the second stage timer (119) for 30 seconds and the third stage timer (121) for 60 seconds. The purpose served by such timer units will be made clear below.

The internal switch of the second stage timer (119) connects between the medium pressure switch (113) and the relay winding of the second stage relay (117). The internal switch of the third stage timer (121) connects between the low pressure switch (121) and the third stage relay (118). The second and third stage relays (117 and 118) will now be described.

Both relays (117 and 118) have two internal switches that are responsive to energization of the relay unit. One such internal switch (123 and 124) in each relay unit (117 and 118) connects to the small blower (18) as described above. The remaining internal switch (126) of the second stage relay (117) connects between pin 3 of the master control unit (122) and the second stage output unit (127), described below. The remaining internal switch (128) of the third stage relay (118) connects between pin 1 of the master control unit (122) and the third stage output unit (129), also described below.

The first stage output unit (131) includes an ignition mechanism (31), the first stage fuel valve (27), the first stage water valve (28) and a first stage indicator light (132). The above four components are connected in parallel between pin 3 of the master control unit (122) and pin 2 of the master control unit (122).

Energization of the first stage output unit (131) will cause the first stage fuel valve (27) to open and allow fuel to flow from the fuel supply into the combustion chamber (11). The first stage water valve (28) will also open to allow water to flow from the water supply into the combustion chamber (11), where it may be converted into steam. The ignition mechanism (31) will operate to cause the fuel being delivered to the first stage burner (23) to ignite. Finally, the first stage indicator light (132) will energize and signal the functioning of the first stage output unit (131).

The second stage output unit (127) includes the large blower (17), the second stage fuel valve (36), the second stage water valve (37) and a second stage indicator light (133). The above four components are connected in parallel between the second internal switch (126) of the second stage relay (117) (as described above) snd pin 2 of the master control unit (122).

Energization of the second stage output unit (127) will cause the second stage fuel valve (36) to open and allow fuel to flow from the fuel supply to the second stage burner (24). The second stage water valve (37) will also open to allow water to flow from the water supply into the combustion chamber (11). The larger blower (17) will operate to introduce combustible air into the combustion chamber (11). Finally, the second stage indicator light (133) will energize and signal the functioning of the second stage output unit (127).

The third stage output unit (129) includes the third stage fuel valve (42), the third stage water valve (43) and a third stage indicator light (134). The above three components are connected in parallel between the second internal switch (128) of the third stage relay (118) (as described above) and pin 2 of the master control unit (122).

Energization of the third stage output unit (129) will cause the third stage fuel valve (42) to open and allow fuel to flow from the fuel supply to the third stage burner (26). The third stage water valve (43) will also open to allow water to flow from the water supply into the combustion chamber (11). Finally, the third stage indicator light (134) will energize and signal the functioning of the third stage output unit (129).

The starting unit (11) includes an on/off switch (136), a push-button start switch (137), a first stage starting relay (116), and certain fail mode detection and protection devices.

The on/off switch (136) connects through a fuse (138) to one line (139) of a standard ac power source, and to the relay winding of a water low pressure switch (141), the function of which will be made clear below. The water low pressure switch (141) then connects through an overheat switch (142) to a spring-biased normally open push-button start switch (137), which connects to pin 1 of the master control unit (122).

The remaining connecting line (143) to the power source connects through a high pressure switch (144) to the relay windings of the first stage starting relay (116). The first stage starting relay (116) then connects to pin 1 of the master control unit (122).

The internal switch of the first stage starting relay (116) connects in parallel with the push button start switch (137), and also to an indicator light (146).

Figure 3:
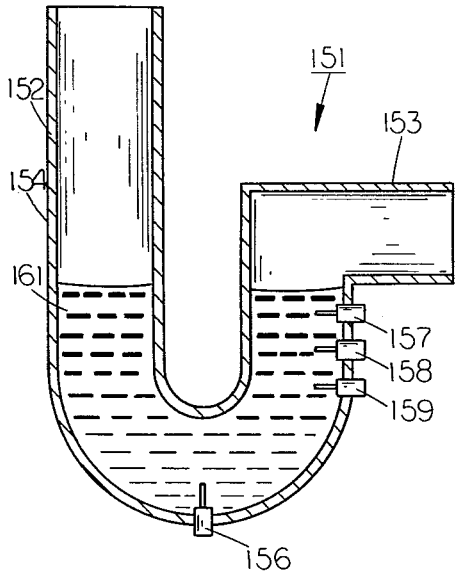
FIG. 3 is a front elevational sectioned view of the pressure switch.
Figure 4:
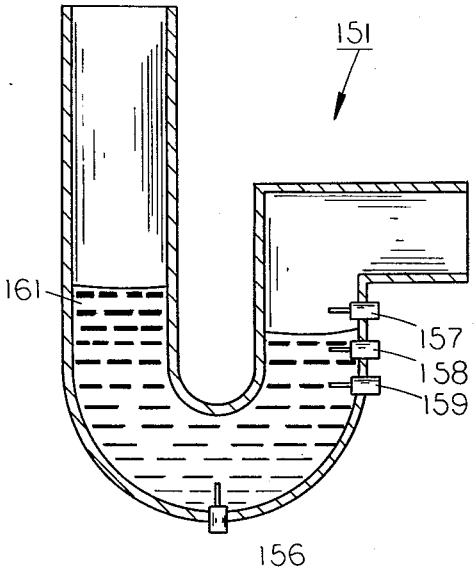
FIG. 4 is a front elevational sectioned view of the pressure switch.
Figure 5:
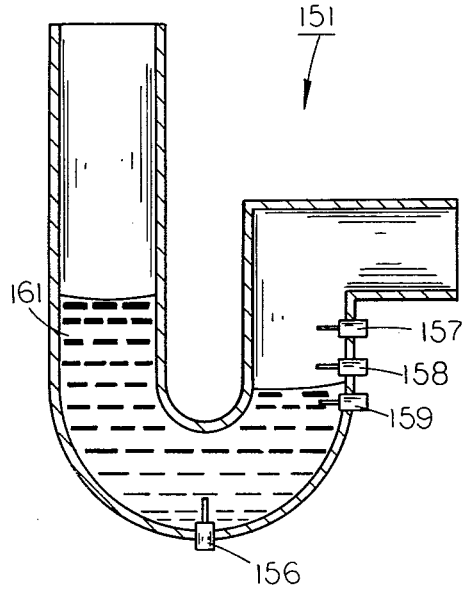
FIG. 5 is a front elevational sectioned view of the pressure switch.

An improved pressure switch (151) for use in monitoring combustion chamber output pressure and for signalling low presure, medium pressure and high pressure conditions to thereby control energization and de-energization of the first, second and third stages will now be described with reference to FIGS. 3, 4 and 5.

The pressure switch (151) includes generally a tube (152) constructed of an electrically neutral substance, such as glass or preferably plastic. The tube (152) should be shaped in the manner of a U, with one leg (153) being bent at an angle of approximately 90°. An electrical conductor (156) extends through the tube (152) at the bottom thereof, and three conductors (157, 158 and 159) pierce the bent leg (153) at selected intervals. Finally, the tube (152) should be filled with an appropriate conductive fluid (161), such as mercury.

Upon pneumatically connecting the bent leg (153) to the output (22) of the combustion chamber (11), the level of mercury (161) in the bent leg (153) will depend upon the output pressure from the combustion chamber (11). If atmospheric conditions prevail in the chamber output (22), then the mercury (161) will be evenly situated in both legs (153 and 154). As pressure beyond atmospheric conditions builds up in the output (22) the level of mercury (161) in the bent leg (153) will be pushed downwards. How far down the level of mercury (161) will drop depends exactly upon the output pressure.

Mercury conducts electricity. Therefore, a current introduced through the three terminals (157, 158 and 159) located on the bent leg (153) will travel to the common terminal (156) located at the bottom of the U.

As a result, the tube (152) acts as a normally closed switch. When the three terminals (157, 158 and 159) are placed at heights corresponding to particular pressures, the applicability of this switch with the variable output direct fired boiler should be clear.

For example, the top terminal (157) may be set at a position equal to 105.45 grams of pressure per square centimeter (1½ pounds of pressure per square inch) above atmospheric conditions, the middle terminal (158) may be set at a position equal to 210.90 grams (3 pounds), and the lowest terminal (159) may be set at a position equal to 351.50 grams (5 pounds). The lowest terminal (159) would serve to direct energization or de-energization of the first stage high pressure system, the middle terminal (158) would control the second stage medium pressure system, and the top terminal (157) would control the third stage low pressure system.

If the pressure in the combustion chamber output (22) forced the level of mercury (161) to a position between the highest (157) and medium terminal (158) (see FIG. 4), then the first and second stages would be energized, but the third would not. If the pressure forced the mercury (161) to between the medium (158) and lowest terminals (159) (see FIG. 5), then only the first stage would be energized and the second and third stages would not.

Operation of the variable output direct fired boiler may now be described. For purposes of this explanation, it will be assumed that the high pressure switch (144) has been set at 351.50 grams/cm$^2$ (5 pounds/in$^2$) over atmospheric conditions, the medium pressure switch (113) has been set at 210.90 grams/cm$^2$ (3 pounds/in$^2$), and the low pressure switch (114) has been set at 105.45 grams/cm$^2$ (1½pounds/in$^2$). It will also be assumed that the second stage timer (119) has been set for 30 seconds and the third stage timer (121) has been set for 60 seconds.

Initially, the operator closes the on/off switch (136) in the starting unit (111). Under low water pressure conditions, the normally open water pressure switch (141) will remain open, the low water pressure indicator light (162) will energize and the power source will be cut off from the remainder of the boiler control circuitry. With adequate water pressure available, the water pressure switch (141) will close. Upon closing the on/off switch (136), the ready light (162) will energize to indicate that the boiler controls may now be energized.

Upon closing the normally open push-button start switch (137), the first stage starting relay (116) energizes and closes the switch connected in parallel across the push-button start switch (137). When the operator removes finger-pressure from the push-button start switch (137), it will open. The first stage starting relay (116) will remain closed, however, until such time as the operator opens the on/off switch (136), the high pressure switch (144) opens, or the water pressure or overheat switch (141 or 142) should open.

At this point the master control unit (122) becomes energized through terminal 1. In turn, the master control unit (122) energizes the small blower (18) through terminal 8 to purge the combustion chamber (11) for a preselected period. The master control unit (122) monitors the purging process through a pressure switch connected to terminals 6 and 7.

Upon concluding the purge cycle, the master unit (122) energizes terminal 3. This in turn will energize the ignition mechanism (31), the first stage fuel valve (27) and water valve (28), and the first stage indicator light (132). When the ignition mechanism (31) has initiated combustion at the first stage burner (23), the master control unit (122) confirms this through the flame detection device connected to terminals F and G.

When combustion has been confirmed, the master control unit (122) energizes terminal 5, which connects to the second and third stage medium and low pressure switches (113 and 114). If the monitored pressure in the output (22) of the combustion chamber (11) should be at, say, 70.30 grams/cm$^2$ (1 lb./in$^2$) over atmospheric conditions, then both the second and third stage timers (119 and 121) will be activated. When 30 seconds pass, the second stage timer (119) will close and energize the second stage relay (117).

When the second stage relay (117) energizes, both of its internal switches (123 and 126) close. Upon closing, the first switch (123) opens the circuit between the small blower (18) and terminal 8 of the master control unit (122). In consequence, the small blower (18) stops operating. At the same time, the second internal switch (126) closes the circuit between terminal 3 of the master control unit (122) and the second stage output unit (127). This will energize the components of the second stage output unit (127), including the large blower (17), the second stage fuel and water valve (36 and 37) and the second stage indicator light (133).

This will result in fuel being delivered to the second stage burner (24) as well as to the first stage burner (23). The second stage burner (24) will be ignited by relative proximity to the flame from the first stage burner (23). Consequently, both the first and second stage burners (23 and 24) will be burning, both will be receiving an appropriate measure of water to be converted to steam, and sufficient combustion air will be present because the large blower (17) will be operating.

If the monitored output pressure were now to rise to, say 281.20 grams/cm$^2$ (4 lbs./in.$^2$), then both the second and third stage pressure switches (113 and 114) would open. This would cause the second stage relay (117) to open the circuit between terminal 3 of the master control unit (122) and the second stage output unit (127). At the same time the small blower (18) would be reconnected to terminal 8 of the master control unit (122). In short, the boiler would operate in the same mode as it did prior to when the second stage timer (119) energized the second stage relay (117).

If the monitored output pressure did not rise to 281.20 grams/cm$^2$ (4 lbs./in.$^2$), and instead remained at, say, 70.30 grams/cm$^2$ (1 lb./in.$^2$), operation would proceed differently. Both the second and third stage pressure switches (113 and 114) would remain closed. Thirty seconds after the second stage timer (11) closed, the third stage timer (121) would close and energize the third stage relay (118).

Upon energizing the third stage relay (118), its two internal switches (124 and 128) will close. One switch (124) will close a circuit between the small blower (18) and terminal 1 of the master control unit (122). The remaining switch (128) will close a circuit between the third stage output unit (129) and terminal 1 of the master control unit (122). Energization of the former will cause the third stage fuel and water lines to open and the third stage indicator light (134) to light. The third stage burner (26) will ignite because of its proximity to the first and second stage burners (23 and 24). All three burners (23, 24 and 26) will have sufficient air to support combustion because both the small and the large blower (18 and 17) will now be operating.

The boiler will continue to operate in this mode so long as the monitored pressure remains below 105.45 grams/cm$^2$ (1½ lbs./in.$^2$). As output pressure rises above this the third stage pressure switch (114) will open. This will cause the small blower (18) to de-energize and it will extinguish the third stage burner (26) for lack of fuel.

If pressure continues to rise, the second stage pressure switch (113) will open, the second stage burner (24) will extinguish, the large blower (17) will stop, and the small blower (18) will restart. If output pressure exceeded 351.50 grams/cm$^2$ (5 lbs./in.$^2$) the first stage pressure switch (144) would open and the boiler would stop functioning.

It will be appreciated that this boiler modifies its combustion activity and energy consumption in response to output pressure. Furthermore, the boiler controls the delivery of both water and air such that there is always a sufficient quantity of both; never too much, never too little.

I claim:

1. A boiler apparatus comprising:

(a) a combustion chamber for receiving fuel and oxygen in sufficient quantitites to support combustion and for continuously receiving liquid water during combustion for conversion of same to steam, said combustion chamber including an output for exiting the atmospheric contents of said combustion chamber;

(b) a plurality of combustion stages, each such stage including at least one burner located within said combustion chamber;

(c) pressure sensing means operably connected to said output for sensing output pressure and to said combustion stages for controlling how many of said stages are operating at a given moment in response to output pressure;

(d) a plurality of fuel valves, at least one each for each said combustion stage, such that the delivery of fuel to said burners may be selectively controlled by said pressure sensing means.

(e) a plurality of water valves, at least one each for each said combustion stage, such that the delivery of liquid water to said combustion chamber for conversion to steam may be selectively controlled by said pressure sensing means; and (f) liquid-to-steam converter having pneumatic pathway formed therein, an input operably connected to said combustion chamber, and an output, such that atmospheric contents from said combustion chamber may be introduced into said converter and moved through said pneumatic pathway to thereby assist in converting any remaining liquid water particles to steam.

2. The boiler apparatus of claim 1 and further including oxygen delivery means for deliverying oxygen to said combustion chamber, the quantity of oxygen so delivered being selectively controlled by said pressure sensing means.

3. The boiler apparatus of claim 2 wherein said oxygen delivery means includes turbulence means for preventing the immediate flow of oxygen through said combustion chamber and for encouraging a slower passage of oxygen through said combustion chamber to thereby aid in ensuring an adequate supply of oxygen for combustion at said burners.

4. The boiler apparatus of claim 1 wherein:

(a) there are at least three said combustion stages, each said combustion stage including:

(i) at least one fuel valve to control the delivery of fuel to the burner associated with that combustion stage; and (ii) at least one water valve to control the delivery of water to said combustion chamber; and (b) said pressure sensing means includes at least three pressure sensing switches, with said first pressure sensing switch being operably connected to the fuel valve and water valve that are associated with the first of said three combustion stages, said second pressure sensing switch being operably connected to the fuel valve and water valve that are associated with the second of said three combustion stages, and said third pressure sensing switch being operably connected to the fuel valve and water valve that are associated with the third of said three combustion stages.

5. The boiler apparatus of claim 4 and further including a first and second timing means operably connected to said second and third pressure sensing switch, respectively, for delaying operation of said second and third combustion stages, respectively, for a preselected period of time following activation of said second and third pressure sensing switch, respectively.

6. The boiler apparatus of claim 4 and further including oxygen delivery means for delivering oxygen to said combustion chamber, said oxygen delivery means being operably connected to said pressure sensing means such that a first rate of delivery of oxygen is provided when the fuel valve and water valve associated with said first combustion stage are operating, a second rate of delivery of oxygen is provided when the fuel valve and water valve associated with said second combustion stage are operating, and a third rate of delivery of oxygen is provided when the fuel valve and water valve associated with said third combustion stage are operating.

7. The boiler apparatus of claim 6 wherein said oxygen delivery means includes turbulence means for preventing the immediate flow of oxygen through said combustion chamber and for encouraging a slower passage of oxygen through said combustion chamber to thereby aid in ensuring an adequate supply of oxygen for combustion at said burners.

8. The boiler apparatus of claim 4 wherein said three pressure sensing switches are comprised of a substantially U-shaped tube made of electrically non-conductive material, one leg of said tube being bent to facilitate pneumatic connection to the output of said combustion chamber and the remaining leg of said tube being open-ended, said tube also including four electrical conductors located therewithin, and said tube being filled with a liquid electrical conductor.

9. The boiler apparatus of claim 8 wherein said liquid electrical conductor is mercury.

* * * * *